US007360287B2

(12) United States Patent
Cerruti et al.

(10) Patent No.: US 7,360,287 B2
(45) Date of Patent: Apr. 22, 2008

(54) COUPLING DEVICE FOR RESTRAINING BELTS, PARTICULARLY FOR CHILDREN'S SAFETY SEATS FOR MOTOR VEHICLES

(75) Inventors: Claudia Cerruti, Druento (IT); Bernardo Fassero, Brandizzo (IT)

(73) Assignee: SABELT S.p.A., Turin (IT)

( * ) Notice: Subject to any disclaimer, the term of this patent is extended or adjusted under 35 U.S.C. 154(b) by 0 days.

(21) Appl. No.: 10/562,854

(22) PCT Filed: Jun. 24, 2004

(86) PCT No.: PCT/EP2004/051225

§ 371 (c)(1),
(2), (4) Date: Dec. 27, 2005

(87) PCT Pub. No.: WO2005/000063

PCT Pub. Date: Jan. 6, 2005

(65) Prior Publication Data

US 2006/0137153 A1 Jun. 29, 2006

(30) Foreign Application Priority Data

Jun. 26, 2003 (IT) ..... TO2003A0486

(51) Int. Cl.
*A44B 11/26* (2006.01)

(52) U.S. Cl. ..... 24/633; 24/634; 24/628; 24/630; 24/631; 24/632; 297/468; 297/483

(58) Field of Classification Search ..... 24/633, 24/634, 628, 630, 631, 632; 297/463, 483; 280/801.1

See application file for complete search history.

(56) References Cited

U.S. PATENT DOCUMENTS

| | | | | |
|---|---|---|---|---|
| 4,757,579 | A * | 7/1988 | Nishino et al. | 24/631 |
| 4,809,409 | A | 3/1989 | Van Risen | |
| 5,086,541 | A * | 2/1992 | Auternaud et al. | 16/227 |
| 5,283,933 | A * | 2/1994 | Wiseman et al. | 24/642 |
| 5,584,107 | A * | 12/1996 | Koyanagi et al. | 24/632 |
| 5,606,783 | A * | 3/1997 | Gillis et al. | 24/632 |
| 5,813,097 | A * | 9/1998 | Woellert et al. | 24/631 |
| 6,694,577 | B2 * | 2/2004 | Di Perrero | 24/642 |
| 6,868,591 | B2 * | 3/2005 | Dingman et al. | 24/615 |

FOREIGN PATENT DOCUMENTS

| | | |
|---|---|---|
| DE | 32 19 712 A | 12/1983 |
| DE | 42 20 671 C1 | 12/1993 |
| EP | 1 224 880 A1 | 7/2002 |
| EP | 1 295 541 A1 | 3/2003 |

* cited by examiner

*Primary Examiner*—Robert J. Sandy
*Assistant Examiner*—Marcus Menezes
(74) *Attorney, Agent, or Firm*—Birch, Stewart, Kolasch & Birch, LLP

(57) ABSTRACT

A coupling device for restraining belts, particularly for children's safety seats for motor-vehicles, which includes a body intended to be connected to at least one belt branch and a pair of tongue elements intended to be connected to respective belt branches, each tongue element including an attachment portion for connection with the respective belt branch and a stem portion arranged to be received and locked in the body and forming a catch tooth for locking the tongue element in the body. Each tongue element further comprises a metal insert wholly covered by a plastic or rubber housing or coating to protect user from burning from the coupling device which has been exposed to the sun.

12 Claims, 7 Drawing Sheets

COUPLING DEVICE FOR RESTRAINING BELTS, PARTICULARLY FOR CHILDREN'S SAFETY SEATS FOR MOTOR VEHICLES

BACKGROUND OF THE INVENTION

The present invention relates to a coupling device for restraining belts, particularly for children's safety seats used in motor vehicles.

The restraining belts for children's safety seats for motor vehicles are typically constituted by three or five branches, one of which is attached at one of its free ends to the body of a coupling device, or buckle. The other two or four branches are attached at their free ends to respective latching elements, or tongues, adapted to be inserted and locked in the buckle body.

A coupling device of this kind is known for example from European Patent application EP-A-1 295 541.

According to the prior art, the tongues (or the tongue, where a restraining system with only two branches is used) comprise an elongated metal stem, the free end portion of which is variously shaped so as to engage in the buckle body. The stem of the tongue extends from an attachment portion adapted to be connected to the belt and generally made of plastic, in which a slot is provided for connection to the end of the associated branch of the belt. However, such tongues suffer from the drawback that the metal part thereof to be engaged in the buckle body is in view when the belt is not being used and therefore can become warm, especially during hot days and/or when the motor vehicle is exposed to the sun rays, whereby the temperature of the tongue may become dangerously high and could produce burning injuries when contacted particular by children. Moreover, there may be problems of allergies to metals (such as, for example, chrome) which are used in the metal part of the tongue.

SUMMARY OF THE INVENTION

It is therefore the object of the present invention to provide a tongue element for a coupling device for restraining belts, particularly for children safety seats for motor vehicles, which does not suffer from the above-mentioned drawback of the prior art and has a structure strong enough not to break when, in case of a vehicle impact, the belt has to exert a restraining action on the body of the seat occupant.

This and other objects are achieved according to the present invention by virtue of the tongue element which is used as a coupling device for restraining belts having the characteristics as defined by the present invention.

A further object of the present invention is to provide a coupling device for restraining belts containing three branches, particularly for children safety seats for motor vehicles, which can operate with the above tongue element and has a simple and strong structure and a safe and reliable operation, as well as a low cost.

BRIEF DESCRIPTION OF THE DRAWINGS

Further characteristics and advantages of the present invention will result from the following detailed description, given purely by way of non-limiting example, with reference to the appended drawings, in which.

DETAILED DESCRIPTION OF THE INVENTION

Figure 1:
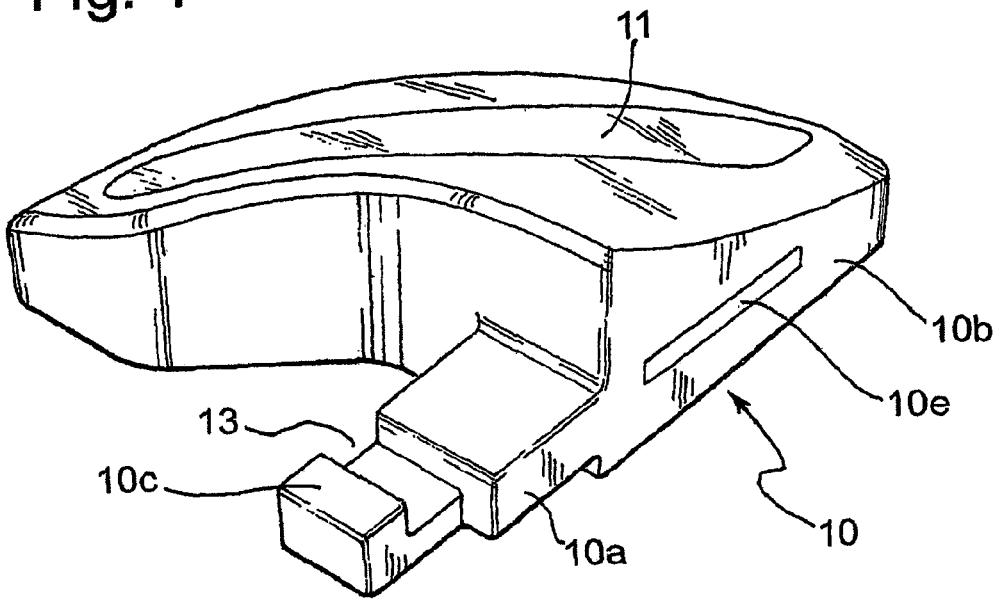
FIG. 1 shows a perspective view of a tongue element for a coupling device for a restraining belt having three branches according to the present invention.
Figure 2A:
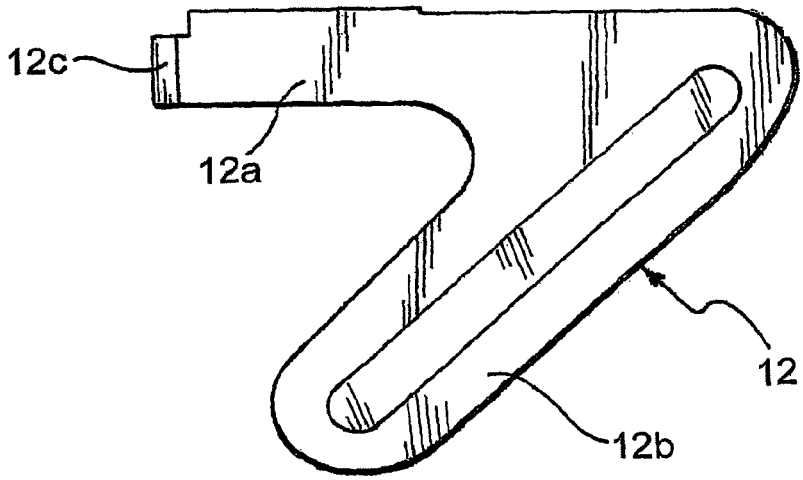
FIGS. 2*a* and 2*b* show in a plan view and in a side elevation view, respectively, a metal insert for the tongue element of FIG. 1.
Figure 2B:
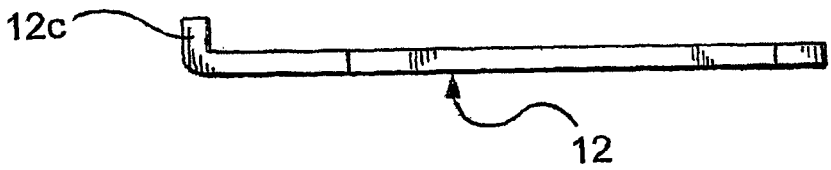
Figure 3:
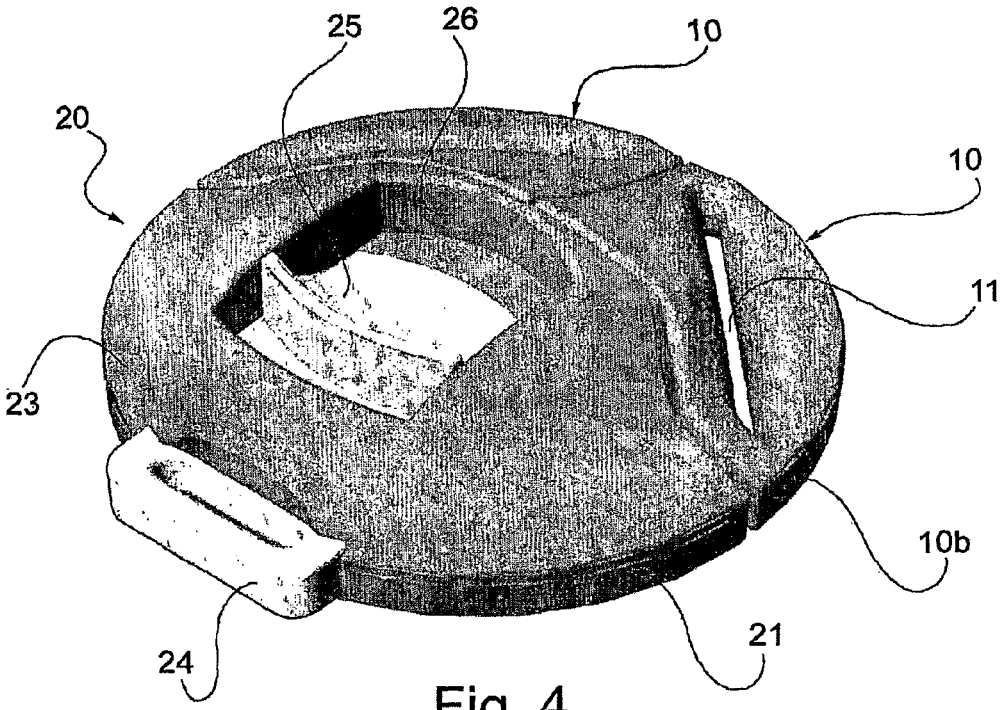
FIG. 3 shows in perspective view a coupling device for restraining belts containing three branches according to the present invention, to be used with a pair of tongue elements of the same type as that illustrated in FIG. 1.

Referring first to FIGS. 1, 2*a* and 2*b*, a tongue element (here, the element on the right) to be used in a coupling device for restraining belts containing three branches, particularly for children's safety seats for motor vehicle, is generally indicated by 10. The tongue element 10 comprises a stem portion 10*a* adapted to be inserted and locked in the body of the coupling device, or buckle, as will be explained in detail later. The stem portion 10*a* extends from an attachment portion 10*b*, in which a slot 11 is provided for attachment to an end of an associated belt branch (not illustrated). The tongue element 10 includes a metal insert 12 (FIGS. 2*a* and 2*b*) forming integrally a first branch 12*a* which extends in the stem portion 10*a* and a second branch 12*b* which extends in the attachment portion 10*b* and in which the slot 11 is provided. According to the invention, the tongue element 10 is produced by overmolding of plastics or rubber over the insert 12 so as to form a housing which covers the entire insert, including the said first branch 12*a*. Therefore, unlike the above discussed prior art, the tongue element 10 does not have any exposed metal part which could become overheated by the sun and thus produce burning of a child or cause allergic reactions by anyone handling the coupling device. Moreover, as the metal insert extends substantially through the whole tongue element, the element is provided with a high mechanical strength and can thus be applied also to seats for children of greater size, for which the restraining systems have to operate under more difficult loading conditions.

In the illustrated example, the insert 12 forms, at the free end of the said first branch 12*a*, a limb 12*c* folded over upwards at a right angle and serving to stiffen a catch tooth 10*c* formed by the tongue element 10 at the end of the stem portion 10*a*. Between the catch tooth 10*c* and the remaining part of the stem portion 10*a* there is formed, in the housing of plastics or rubber covering the insert 12, a recess 13 defining a seat intended to engage a movable member for locking of the tongue element 10, as will be explained later.

As the metal insert 12 is intended essentially only to stiffen the tongue element 10, this latter can have a very simple shape (as that shown in FIGS. 2*a* and 2*b*) and can thus be manufactured at low costs, by a simple blanking and/or folding operations.

Referring now in particular to FIGS. 3, 4, 4*a* and 4*b*, a coupling device for three-branch restraining belts, particularly for children's safety seats for motor vehicles, is generally indicated by element 20 and is provided with a pair of tongue elements 10, left and right respectively, of the same type as the one described above. The device 20 comprises a body 21 which is intended to be attached to a first belt branch (not illustrated) and houses a latching mechanism for the releasable connection of the body 21 with the two tongue elements 10, which are intended in their turn to be attached to second and third belt branches (also not illustrated).

The body 21 comprises a support element 22, preferably made of metal, on which the various components of the latching mechanism are mounted, and a shell 23, preferably made of plastics or rubber, which is formed as a single piece overmolded over the support element 22 or is comprised of two separate half-shells fitted to each other so as to almost completely cover the element 22. The support element 22 is connected with the first belt branch, at the opposite end to that intended for attachment to the two tongue elements 10, by means of a slotted portion 24 projecting out of the shell 23. A release push-button 25 is slidably mounted in the coupling direction of the tongue elements 10 (hereinafter called longitudinal direction) in a seat 26 formed on the upper side of the body 21. The push-button 25 is held by the biasing force of a spring (not illustrated) in a coupled position, in which the tongue elements 10 are locked in the body 21, and can be moved, acting against the resilient force of the spring of the push-button, to a released position, in which the tongue elements 10 can be ejected from the body 21.

Figure 4:
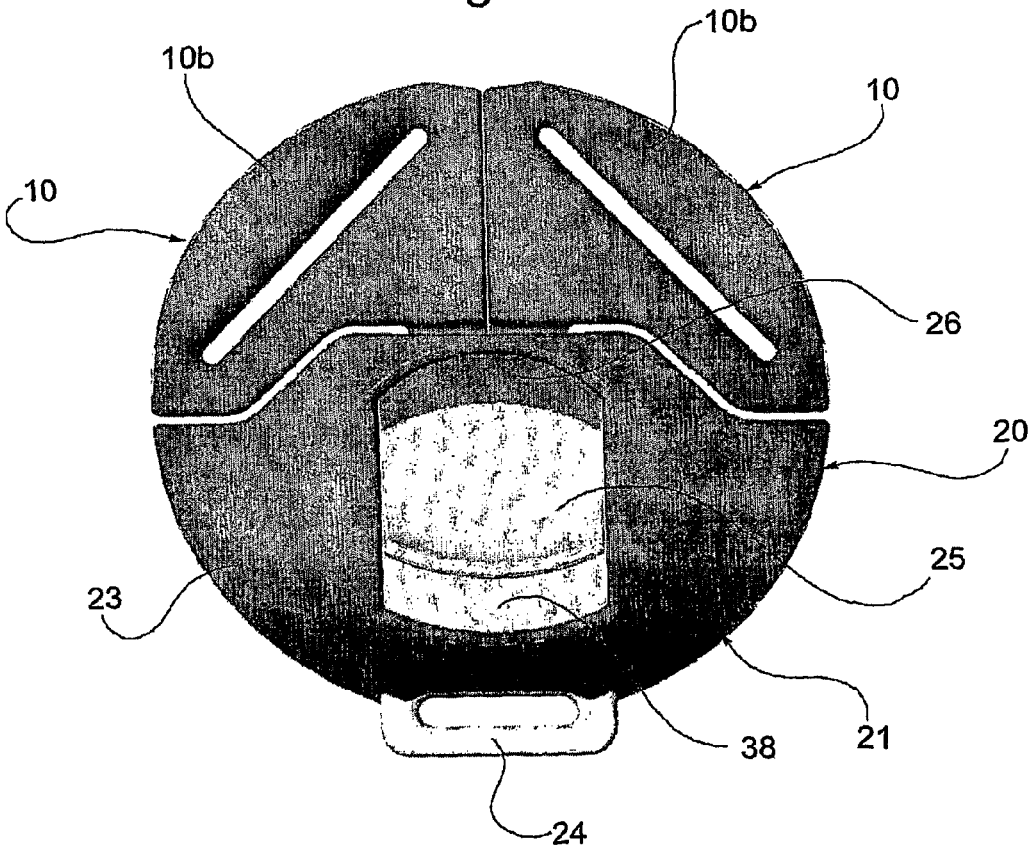
FIG. 4 is a plan view of the coupling device of FIG. 3, in the coupled position.
Figure 4A:
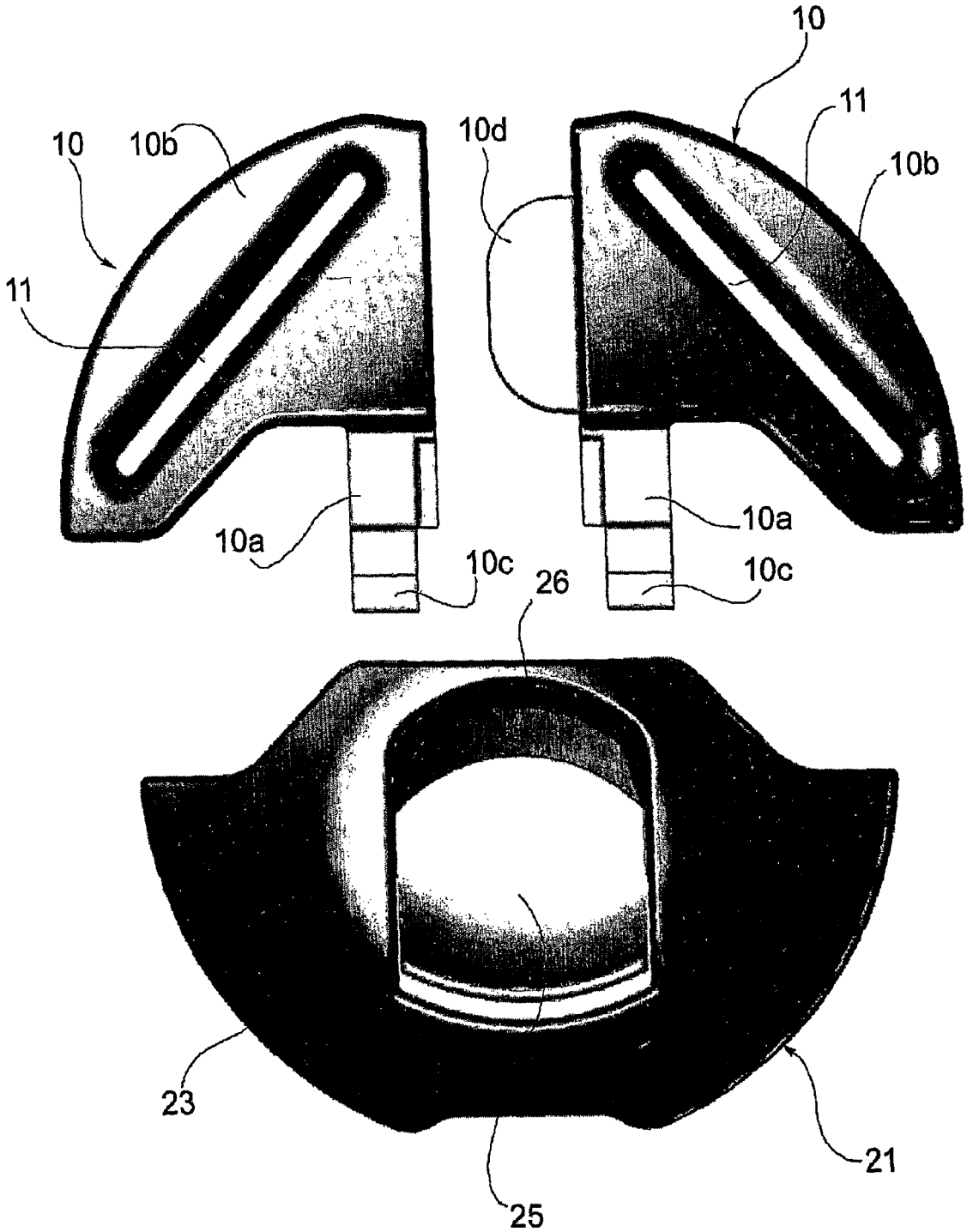
FIGS. 4*a* and 4*b* are similar views to that of FIG. 4 and illustrate in sequence two operating positions of the device during its operation.
Figure 4B:
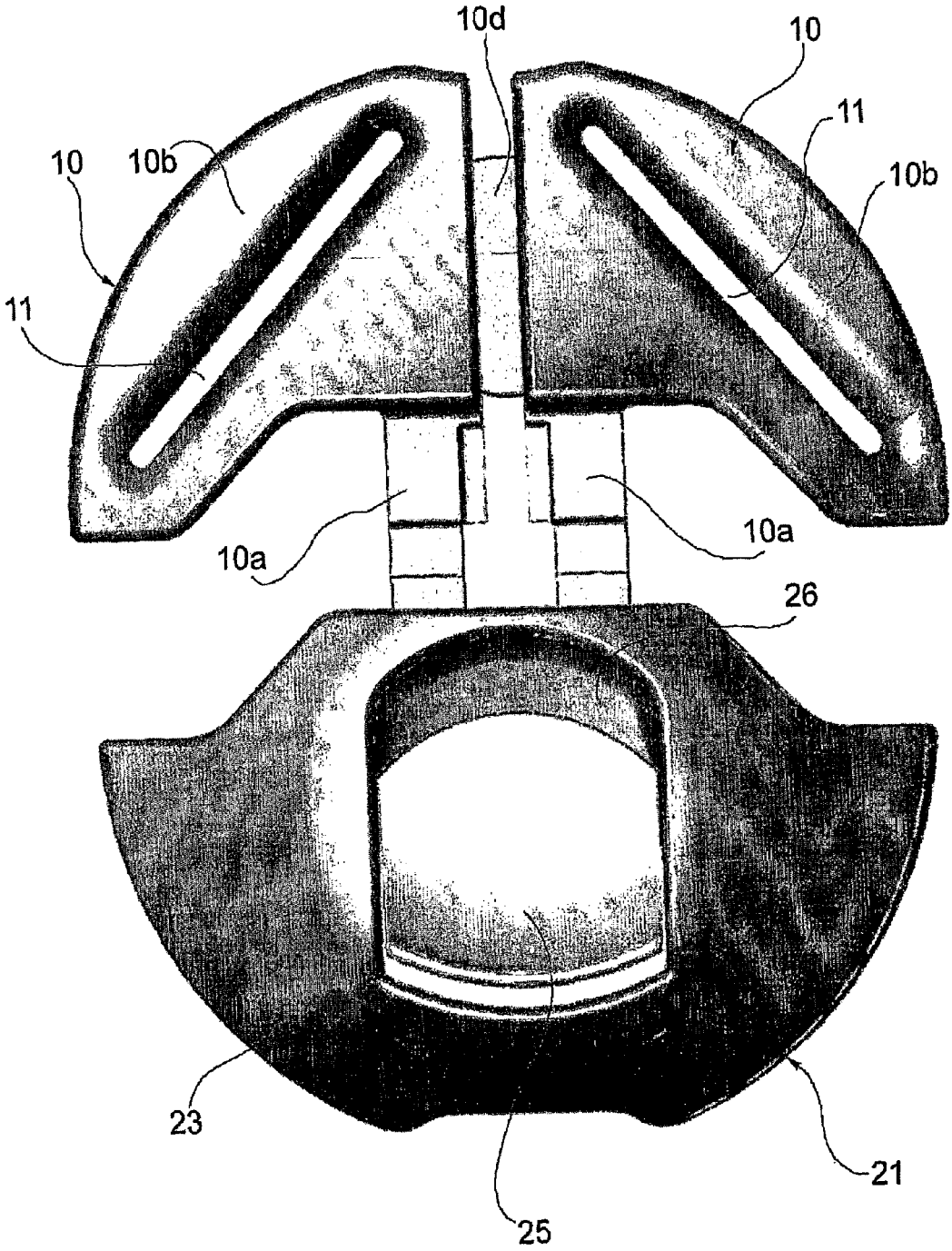

Moreover, in order to ensure the alignment of the two tongue elements 10 when they are inserted in the body 21, these elements have respective connecting members in their respective attachment portions 10*b*, on the inner side, which members are constituted in the illustrated example by a lateral inner projection 10*d* (FIG. 1) formed by the one element 10 (here, the left-hand element) and by a recess 10*e* provided in the other element for receiving the projection 10*d* (FIGS. 4*a* and 4*b*).

Referring now in particular to FIGS. 5 to 8, the latching mechanism of the coupling device according to the present invention will be described. The support element 22 (schematically illustrated in FIG. 5 and in greater detail in FIG. 8) has, at an opposite end to the one attached to the associated belt branch, a through opening 28 of rectangular section in which the stem portions 10*a* of the two tongue elements 10 can be inserted. The element 22 forms also a substantially parallelepiped cavity 29 in connection with the opening 28, in which cavity a pair of sliders 30 (one for each tongue element 10) are longitudinally slideable.

Figure 7:
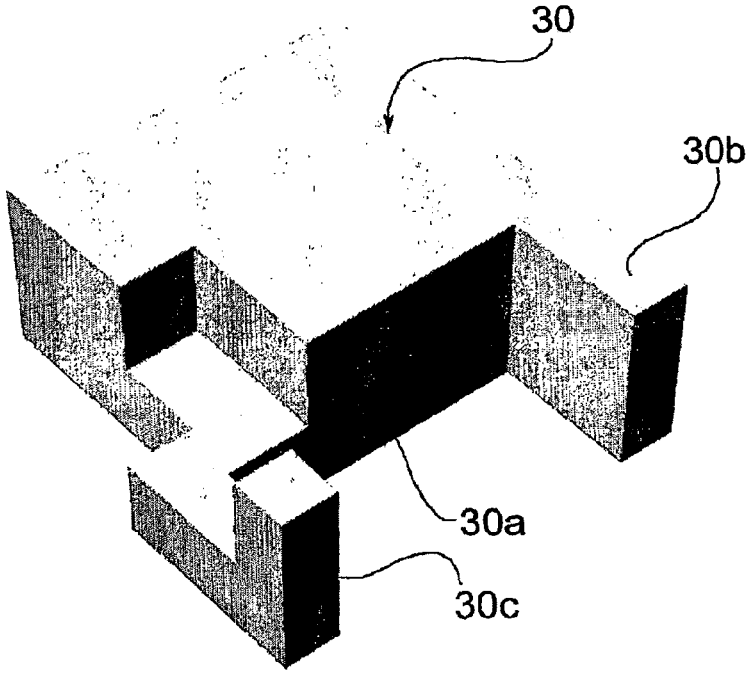

The sliders 30, one of which is shown in detail in FIG. 7, are urged frontward by an ejection spring (not illustrated), that is in the opposite direction to that of insertion of the tongue elements 10, so as to react, during the coupling operation, to the insertion of the tongue elements and facilitate, during the release operation, the ejection of these elements. Each slider 30 has a front abutment surface 30*a* for the respective tongue element 10 and forms a laterally outer extension 30*b* which projects frontward and is intended to abut against a respective abutment surface 29*a* formed by the seat 29 (FIG. 8) in order to prevent the slider from slipping out of the body 21 when the tongue elements 10 are not inserted. The two sliders 30 also form respective laterally inner extensions 30*c* which are shaped in such a manner as to allow a certain amount of relative movement of the sliders in the longitudinal direction, in order to hinder the closing of the device when only one element 10 is inserted in the body 21, as will be explained in detail later.

Figure 5:
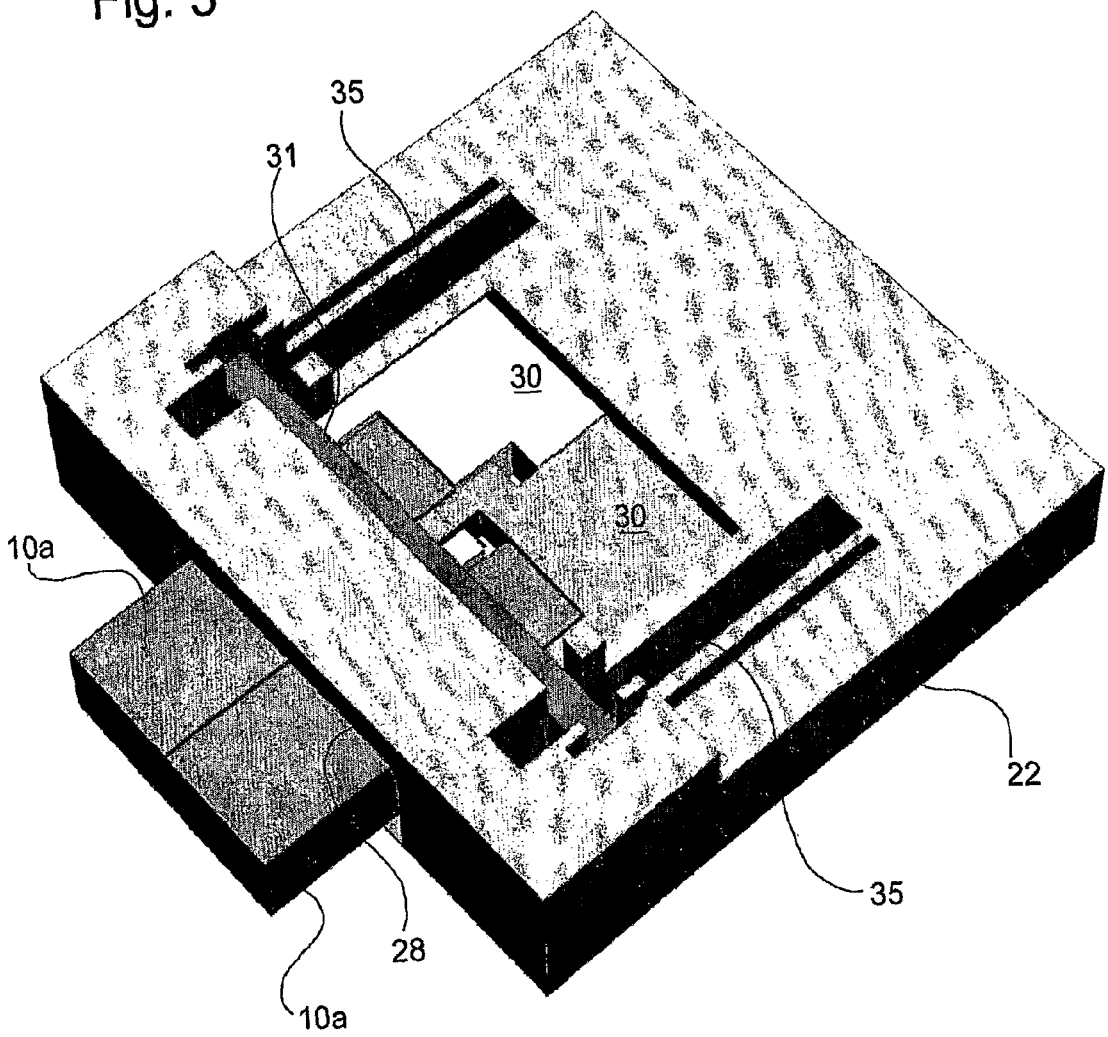
FIG. 5 shows schematically, in perspective view, the latching mechanism of the device of FIG. 3.

In order to lock the tongue elements 10 in the body 21 there is provided a locking rod 31 (FIG. 5) which extends transversely, that is, perpendicularly to the longitudinal direction above defined, and is received in a seat 32 (clearly visible in FIG. 8) so as to be vertically movable between a lowered position (shown in FIG. 5). The rod engages in the recesses 13 formed by the stem portions 10*a* of the two tongue elements 10, thereby hindering its release from the body 21. A raised position (not shown), in which the rod disengages the recesses 13, allows the two elements 10 to be ejected from the body 21. The rod 31 is subjected to the resilient force of a spring (not illustrated) which tends to urge it downwards, that is, to a coupled position.

When the sliders 30 are disposed in the forward position, urged by the springs against the respective abutment surfaces 29*a*, their outer extensions 30*b* and 30*c* prevent the locking rod 31 from lowering into the coupled position. Thus, if only one tongue element 10 is inserted into body 21, it would push backwards the associated slider 30 against the action of the respective spring. However, the other slider would stay in the forward position thereby preventing the locking rod 31 from lowering. By virtue of such a provision, the device prevents one tongue element 10 only from being locked in body 21, thus protecting the belt from being worn in an incorrect manner.

Figure 6:
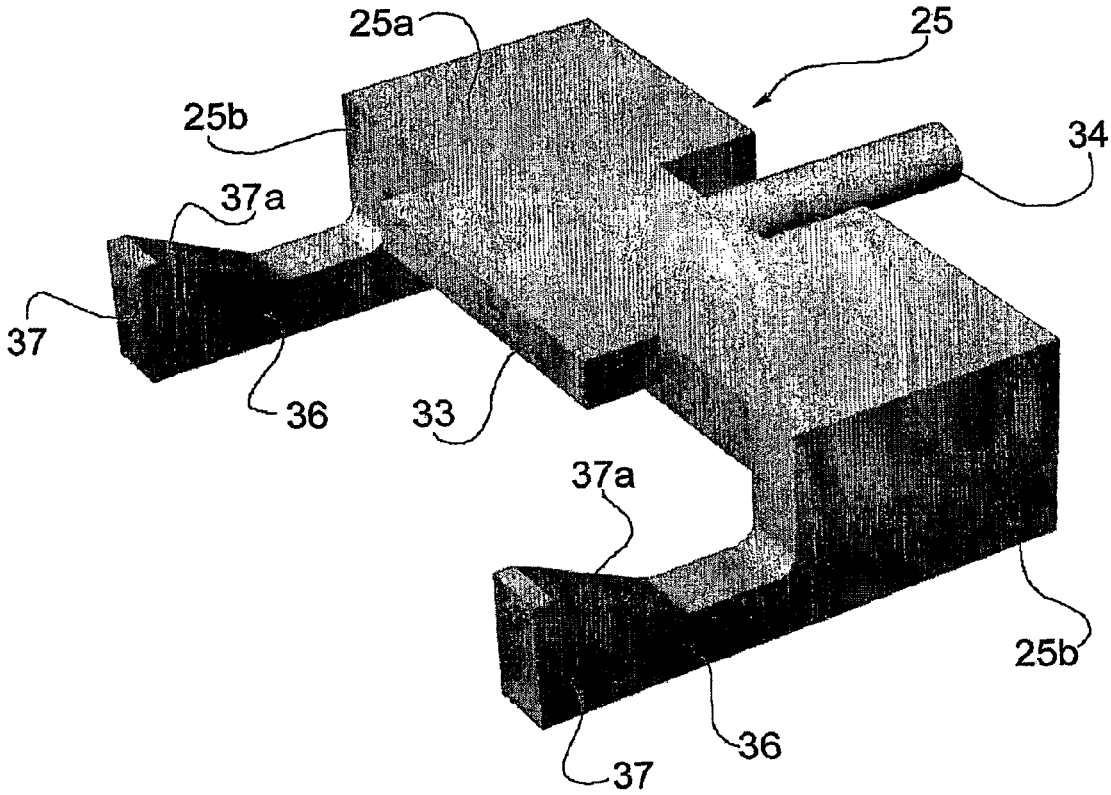
FIGS. 6 and 7 show schematically, in perspective view, a releasing push-button and a slider element utilized in the latching mechanism of FIG. 5.
Figure 8:
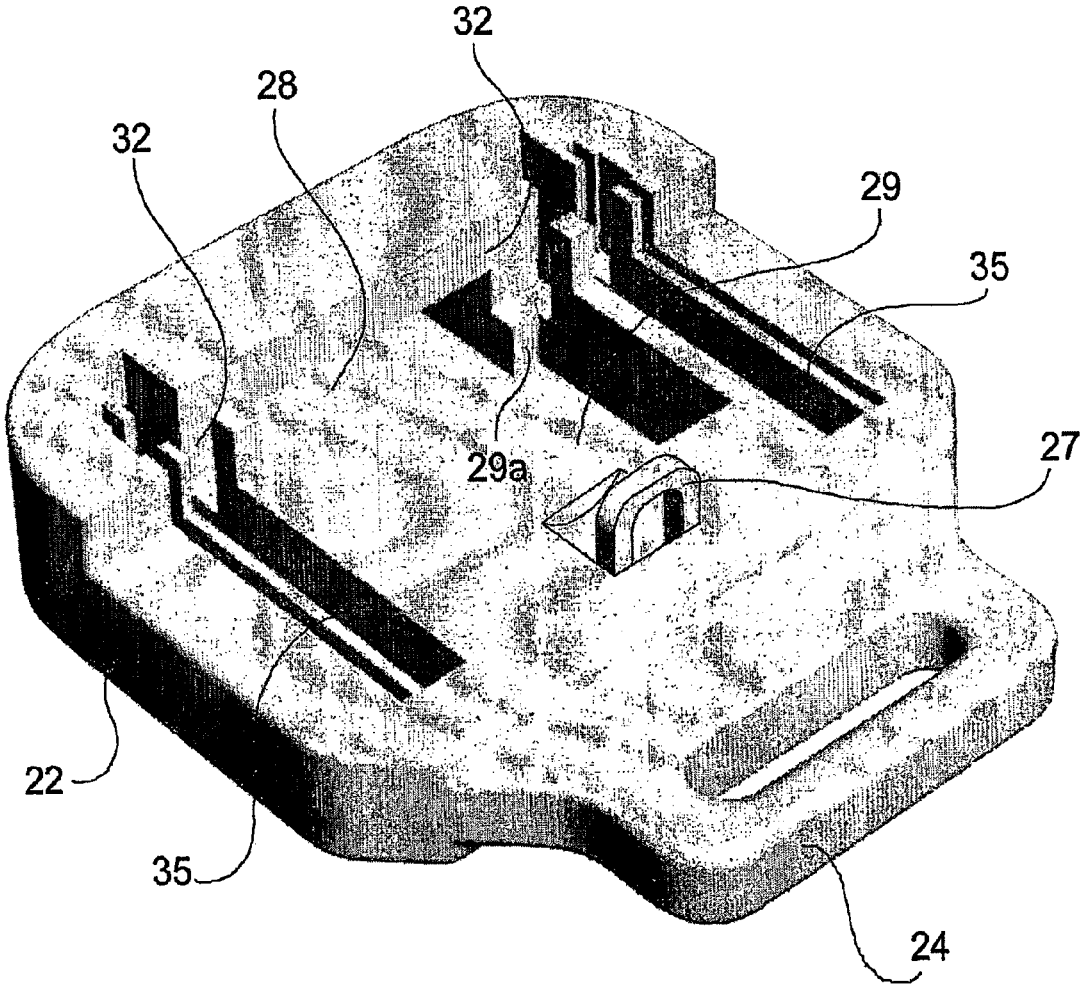
FIG. 8 shows, in perspective view, a metal support element in which the latching mechanism of FIG. 5 is received.

The latching mechanism further includes the push-button 25 previously mentioned, which is illustrated in detail in FIG. 6. The push-button 25 is constituted substantially by a shaped piece, preferably of plastics, comprising an upper plate portion 25*a* and a pair of side portions 25*b* which extend vertically downwards from the upper portion 25*a*. The upper portion 25*a* forms on the front side, that is, on the side facing the opening 28 in which the tongue elements are inserted, a projection 33 serving as a safety abutment element. When the push-button 25 is in the coupled position, the projection 33 is disposed over the locking rod 31 and prevent the latter from moving towards the raised position. Moreover, the upper portion 25*a* fomms on the back side a cylindrical extension 34 which serves as a guide element for the spring of the push-button. This spring abuts, on the side of the support element 22, against a projection 27 formed by the element 22 (FIG. 8).

The side portions 25*b* of the push-button 25 are slideably mounted on the support element 22 along a pair of longitudinal guides 35 to allow the push-button 25 to move between the said coupled and released positions. Moreover, the side portions 25*b* integrally form respective legs 36 extending forward and slidably disposed in the guides 35. Each of these legs 36 forms, at its front side, a ramp-like portion 37 having a slanted upper surface 37*a* intended to work together with the locking rod 31 so as to cause the rod to raise when the push-button 25 (and thus the legs 36) is moved backwards to the released position.

Advantageously, in order to enable the user to easily realize whether the belt has been coupled correctly, the push-button 25 has on its upper side a colored area 38 (which can be observed in the view of FIG. 4) which can be easily distinguished with respect to the remaining part of the push-button, which part is hidden in the body 21 when the push-button 25 is in the released position and, on the contrary, is visible from the outside when the push-button is in the coupled position.

The operation of the coupling device described above will now be explained, in short. In the coupled position (FIG. 5), the tongue elements 10 are inserted in body 21 of the device through the opening 29 in such a manner that the recesses 13 formed in the stem portions 10*a* project from the opening 29 and are engaged by the locking rod 31, which is held in the coupled, lowered position by the force of the spring of the rod. The projection 33 formed by the push-button 25, which is held in the coupled position by the action of the spring of the push-button, locks the rod 31 from above, preventing the latter from moving upwards and hence from disengaging from the recesses 13 of the tongue elements 10. The sliders 30 are urged by the free ends of the stem portions 10*a* of the tongue elements 10 against the action of the ejection spring of the sliders. It will be noted that in this condition the projection 33 prevents the device from inadvertently releasing when the vehicle on which the restraining system is installed is subjected to bumps, jolts and bounces.

At this point, it is necessary to move the push-button 25 into the released position, acting against the spring of the push-button, in order to release the device. Consequently, the projection 33 integral with the push-button 25 disengages the locking rod 31, which can thus be moved upwards into the released position by virtue of the backward movement of the ramp-like portions 37 of the push-button. As soon as the rod 31 disengages from the recesses 13 of the tongue elements 10, the latter is ejected from the body 21 by virtue of the sliders 30 being pushed forward by the ejection spring of the sliders against the respective abutment surfaces 30*a*. Moreover, in this condition the sliders 30 are below the locking rod 31 and thus prevent the latter, by means of their outer extensions 30*b* and 30*c* from lowering to the coupled position.

As can be easily appreciated in the light of the preceding description, a coupling device according to the present invention has the advantages of a simple and sturdy structure, a safe and reliable operation, as well as low manufacturing costs.

Naturally, the principle of the present invention remaining unchanged, embodiments and manufacturing details may vary widely from those described and illustrated purely by way of non-limiting example.

The invention claimed is:

1. A coupling device for restraining belts, particularly for children's safety seats for motor-vehicles, comprising a body for connecting to at least one belt branch, and a pair of tongue elements, each for connecting to a respective belt branch, wherein each tongue element includes an attachment portion for connection with the respective belt branch and a stem portion arranged to be received and locked in the body, said stem portion defining a catch tooth for locking the tongue element in the body wherein each tongue element includes a metal insert wholly covered and in direct contact by a plastic or rubber housing, said metal insert containing a first part extending into the attachment portion and a second part extending into the stem portion of the tongue element, so that the tongue elements do not have any metal part in view which could become overheated by the sun and thus produce burnings or which could cause allergic reactions on anyone who handles the coupling device for the belt.

2. The coupling device according to claim 1, wherein the metal insert of each tongue element comprises a substantially flat portion and a limb which is arranged substantially at a right angle with respect to the said flat portion for stiffening the catch tooth.

3. The coupling device according to claim 1, wherein the body comprises a latching mechanism including locking means arranged to be moved in a perpendicular direction to the direction of insertion/ejection of the stem portions of the tongue elements into/out of the body from a coupled position, in which the said means engage the catch teeth of the tongue elements to prevent the latter from being ejected from the body, and a released position, in which the said means disengage from the catch tooth, thus allowing the ejection of the elements from the body.

4. The coupling device according to claim 3, wherein the latching mechanism further includes a control pushbutton arranged to be moved parallel to the direction of insertion/ejection of the stem portions of the tongue elements into/out of the body to control the movement of the locking means in the said released position.

5. The coupling device according to claim 4, wherein the said locking means comprises a locking rod and in that the control push-button comprises a ramp-like portion forming a slanted surface adapted to work together with the locking rod to prevent the latter from moving to the released position.

6. The coupling device according to claim 5, wherein the control push-button forms a projection adapted to retain the locking rod in the coupled position when both the tongue elements are inserted into body.

7. The coupling device according to claim 3, wherein the latching mechanism further includes a pair of slider elements, each associated with a respective tongue element, said slider elements being adapted to slide parallel to the direction of insertion/ejection of the stem portions of the tongue elements into/out of the body and are biased by a spring so as to react to the insertion and facilitate the ejection of the tongue elements.

8. The coupling device according to claim 7, wherein the said locking means comprise a locking rod and in that the said slider elements are arranged to prevent a locking rod from moving to a coupled position when both the tongue elements are not inserted into the body.

9. The coupling device according to claim 4, which further comprises identification means associated with the push-button for indicating to the user whether the device is in the coupled position or in the released position.

10. The coupling device according to claim 1, wherein the said tongue elements are provided with connecting members for ensuring the alignment of the tongue elements when these are inserted and anchored in the body.

11. The coupling device according to claim 10, wherein the said connecting members comprise at least a projection formed by the one tongue element and a cavity provided in the other tongue element for receiving the respective projection.

12. A coupling device for restraining belts, particularly for children safety seats for motor-vehicles, comprising a body adapted to be connected to at least one belt branch, and a pair of tongue elements each adapted to be connected to a respective belt branch, wherein each tongue element includes an attachment portion for connection with the respective belt branch and a stem portion arranged to be received and locked in the body, each said stem portion forming a catch tooth for locking the tongue element in the body, wherein the body comprises a latching mechanism including locking means arranged to be moved in a perpendicular direction to the direction of insertion/ejection of the stem portions of the tongue elements into/out of the body from a coupled position, in which the said means engage the catch teeth of the tongue elements to prevent the latter from being ejected from the body, and a released position, in which the said means disengage from the catch tooth, thus allowing the ejection of the elements from the body, the latching mechanism further includes a control pushbutton arranged to be moved parallel to the direction of insertion/ejection of the stem portions of the tongue elements into/out of the body to control the movement of the locking means in the said released position.

* * * * *